US009309890B2

(12) United States Patent
Stone et al.

(10) Patent No.: US 9,309,890 B2
(45) Date of Patent: Apr. 12, 2016

(54) SCROLL COMPRESSOR ASSEMBLY HAVING OIL DISTRIBUTION AND SUPPORT FEATURE

(71) Applicant: DELPHI TECHNOLOGIES, INC., Troy, MI (US)

(72) Inventors: Scott F. Stone, Amherst, NY (US); John F. Quesada, Williamsville, NY (US)

(73) Assignee: Mahle International GmbH, Stuttgart (DE)

( * ) Notice: Subject to any disclaimer, the term of this patent is extended or adjusted under 35 U.S.C. 154(b) by 327 days.

(21) Appl. No.: 13/714,596

(22) Filed: Dec. 14, 2012

(65) Prior Publication Data

US 2014/0170007 A1 Jun. 19, 2014

(51) Int. Cl.

| | |
|---|---|
| ***F01C 1/02*** | (2006.01) |
| ***F01C 1/063*** | (2006.01) |
| ***F03C 2/00*** | (2006.01) |
| ***F16N 13/20*** | (2006.01) |
| ***F01C 21/00*** | (2006.01) |
| ***F04C 29/02*** | (2006.01) |
| ***F04C 18/02*** | (2006.01) |
| *F01C 17/06* | (2006.01) |

(52) U.S. Cl.

CPC ..... *F04C 29/028* (2013.01); *F04C 18/0215* (2013.01); *F04C 18/0261* (2013.01); *F01C 17/066* (2013.01); *F04C 2240/54* (2013.01)

(58) Field of Classification Search

CPC ..... F04C 29/02

USPC ..... 418/55.1–55.6, 270, DIG. 1

See application file for complete search history.

(56) References Cited

U.S. PATENT DOCUMENTS

| | | | | |
|---|---|---|---|---|
| 4,666,381 | A | 5/1987 | Butterworth | |
| 4,874,302 | A * | 10/1989 | Kobayashi et al. | 415/55.3 |
| 5,346,376 | A * | 9/1994 | Bookbinder et al. | 418/55.4 |
| 5,366,359 | A | 11/1994 | Bookbinder et al. | |
| 5,462,362 | A * | 10/1995 | Yuhta | A61F 2/32 384/13 |
| 6,537,045 | B2 | 3/2003 | Reigger et al. | |
| 7,878,777 | B2 * | 2/2011 | Iwanami et al. | 418/55.5 |
| 2009/0304539 | A1 * | 12/2009 | Kii et al. | 418/55.6 |
| 2010/0021330 | A1 | 1/2010 | Haller | |
| 2010/0307173 | A1 * | 12/2010 | Guo et al. | 62/84 |

* cited by examiner

*Primary Examiner* — Jorge Pereiro
*Assistant Examiner* — Deming Wan
(74) *Attorney, Agent, or Firm* — Brinks Gilson & Lione

(57) ABSTRACT

A horizontal scroll compressor assembly for compressing a working fluid and lubricated with oil includes a housing, an interior surface, and a suction sump for collected oil located in the suction plenum. A compression mechanism has an orbital scroll member having a thrust surface axially superposed with the housing and having an oil distribution channel. Oil from the suction sump is received into the distribution channel and delivered to locations between the superposed surfaces during movement of the orbital scroll member. A method for distributing oil in a scroll compressor assembly includes: receiving oil from a suction sump into an oil distribution channel located in the thrust surface of an orbital scroll member; pumping oil along the oil distribution channel to locations between the thrust surface and a superposed housing surface; and lubricating a thrust surface interface with oil.

10 Claims, 4 Drawing Sheets

SCROLL COMPRESSOR ASSEMBLY HAVING OIL DISTRIBUTION AND SUPPORT FEATURE

BACKGROUND OF THE INVENTION

1. Field of the Invention

The present invention relates to a scroll-type compressor assembly for compressing a working fluid and lubricated with an oil, for use in an air conditioning system, and particularly to a scroll compressor assembly for use in an automotive air conditioning system, and to features for distributing oil within scroll compressor assemblies and using the oil for hydrodynamically separating and supporting relatively moving surfaces therein.

2. Description of the Related Art

Scroll-type compressor assemblies for automotive air conditioning systems are well-known in the art. A compressible working fluid such as a refrigerant gas is received into the compressor assembly housing at a suction pressure and discharged therefrom at a relatively higher discharge pressure. In automotive air conditioning systems, a scroll compressor assembly typically has a drive shaft whose rotation axis is generally horizontal and driven by the engine crankshaft through a drive belt coupled to the engine crankshaft pulley, which serves as a rotative power source. The compressor drive shaft is coupled to a compression mechanism within the compressor housing, which may be defined by front and rear casings. The compression mechanism of a scroll compressor assembly typically has an orbital scroll member coupled to the drive shaft and a nonorbital scroll member with which it is operably engaged. The orbital scroll member is driven in a generally circular orbit about the drive shaft rotation axis relative to the nonorbital scroll member.

The orbital scroll member includes a plate with a flat, inner surface that is perpendicular to the rotation axis and an involute wrap integral with the plate and extending out from the inner surface. The cooperating nonorbital scroll member includes a plate with a flat, inner surface that interfaces and is parallel to the inner surface of the orbital scroll member, and an involute wrap integral with its plate that extends from its inner surface. The wraps and flat, inner surfaces of the orbital and nonorbital scroll members cooperate to form fluid pockets which are bound by adjacent surfaces of the interengaged scroll members. These boundaries are established by line contacts between the intermeshed wraps, and contact between the axial tips of the intermeshed wraps and the inner surfaces of the scroll member plates against which the wrap tips are slidably engaged. A seal is normally provided in a groove formed in the axial tip of each involute scroll wrap, to seal between the wrap and the inner surface of the adjacent scroll member plate against which it slides. The axial tip seals are provided to accommodate thermal expansion of the scroll members, and separation therebetween that may result from the forces induced by the compressed fluid in the fluid pockets. An example of a prior such scroll compressor assembly is described in U.S. Pat. No. 5,346,376 (Bookbinder et al.) issued Sep. 13, 1994, the disclosure of which is expressly incorporated herein by reference.

The working fluid at substantially suction pressure, and in which substantially incompressible lubricating oil is entrained, is received in a compression mechanism inlet between the scroll members at a radially outward location. The working fluid/oil admixture received by the compression mechanism is captured within the fluid pockets defined by the interengaged scroll wraps as the orbital scroll member moves about the shaft rotation axis relative to the nonorbital scroll member. The entrained oil lubricates and cools the interengaged scroll members.

During compressor operation, as the orbital scroll member is driven by the rotating shaft, the contact lines and the fluid pockets defined between the intermeshed wraps move along the surfaces of the wraps toward the centers of the cooperating scroll members. The fluid pockets become smaller in volume as they move along the wraps toward the centers of the scroll members, and the working fluid in the fluid pockets is compressed. Thus, the interengaged orbital and nonorbital scroll members define the compression mechanism, and the fluid pockets define compression chambers of the compression mechanism in which the pressure of the contained working fluid/oil admixture is raised from substantially suction pressure to a relatively higher, substantially discharge pressure. A fluid discharge aperture is provided near the center of the nonorbital scroll member, providing a passageway through which the compressed admixture is expelled from the compression mechanism at substantially discharge pressure.

The orbital scroll member plate has an outer face that is located on the outside of the compression mechanism and opposite its flat, inner surface. Defined on the outer face is a flat thrust surface that is substantially parallel with the inner surface. Opposing the axial forces induced by the compressed admixture within the compression mechanism is a planar thrust washer disposed between the thrust surface of the orbital scroll member and a superposed, flat, rear-facing surface of the front casing of the housing. The thrust washer may be retained against movement relative to the front casing, and may include apertures that, with the rear-facing front casing surface, define pockets in which oil is disposed; the oil in these oil pockets lubricates the sliding interface between the thrust washer and the orbital scroll member thrust surface. Such a thrust washer/thrust surface interface is disclosed in above-mentioned U.S. Pat. No. 5,376,376. Despite the presence of such oil pockets, the compressor assembly may still experience frictional losses due to the sliding engagement of the orbital scroll member thrust surface and the thrust washer, particularly if oil is not adequately replenished to the oil pockets.

Conventional thrust bearing assemblies employing needle roller bearings or ball bearings may be positioned between the thrust surface, and the thrust washer or the rear-facing surface of the front casing to axially support the orbital scroll member relative to the housing. Often, such thrust bearing assemblies, though intended to reduce frictional losses, either do not adequately accommodate the orbital motion of the thrust surface relative to the thrust washer or front casing surface, or add significantly to the complexity and/or cost of the compressor assembly. Furthermore, such thrust bearing assemblies have moving parts, the introduction of which may contribute to potential durability concerns in a compressor assembly, particularly if the thrust bearing assemblies are inadequately lubricated.

It would be beneficial if, during compressor operation, lubricating oil were continually distributed to the interface between the orbital scroll member thrust surface and the thrust washer, and was also used for hydrodynamically separating and supporting the orbital scroll member thrust surface relative to the thrust washer and the front casing. Such an improvement would reduce frictional losses without introducing additional complexity or cost, or the potential durability concerns often associated with incorporating additional moving parts.

SUMMARY OF THE INVENTION

The present invention provides the benefits of facilitating oil distribution to the interface between the thrust surface of the orbital scroll member and the thrust washer, for lubricating their interface and hydrodynamically separating and supporting the orbital scroll member relative to the thrust washer and the front casing, with the oil. The improvement reduces frictional losses in the compressor assembly without increasing its complexity or cost, or raising durability concerns associated with the introduction of additional moving parts, and axially supports the orbital scroll member relative to the housing during compressor operation.

A scroll compressor assembly according to the present invention includes a nonorbital scroll member and a cooperating, driven orbital scroll member mounted inside a housing. An orbital scroll member drive shaft is journaled in the compressor housing for rotation about a drive shaft rotation axis, and is operably connected to the orbital scroll member. The housing includes a suction plenum into which is received working fluid at substantially suction pressure and that defines an oil sump (the "suction sump") in which lubricating oil is disposed. The orbital scroll member moves in a circular orbit about the shaft rotation axis within the suction plenum, relative to the housing and the nonorbital scroll member. The scroll members include end plates with parallel flat, inner surfaces and intermeshed involute wraps which cooperate to form fluid pockets, in which is received working fluid in which lubricating oil is entrained. An anti-rotation mechanism prevents rotation of the orbital scroll member relative to the housing and the nonorbital scroll member, and permits its orbital movement relative thereto.

As the drive shaft propels the orbital scroll member, the sealed fluid pockets move toward the centers of the cooperating scroll members and become smaller in volume. As the fluid pockets decrease in volume the fluid in the fluid pockets is compressed to relatively higher pressures. The scroll members thus define a compression mechanism in which the working fluid/oil admixture is received into the fluid pockets, which are compression chambers, at substantially suction pressure and is compressed to substantially discharge pressure as the fluid pocket volume decreases. A fluid discharge aperture or passageway is provided near the center of the nonorbital scroll member for the passage of the working fluid/oil admixture from between the interengaged scroll members into a discharge plenum located in the housing.

The compressor housing rear casing has an interior surface, and the nonorbital scroll member has a rear face. The nonorbital scroll member rear face and the rear casing interior surface cooperate to form the discharge plenum of the compressor assembly. The discharge plenum receives the compressed fluid/oil admixture from between the intermeshed scroll wraps via the fluid discharge aperture at substantially discharge pressure. A compressor discharge port is provided in the rear casing for the delivery of compressed fluid at a discharge pressure from the discharge plenum to the remainder of the refrigerant system. Oil that may become separated from the compressed working fluid/oil admixture in the discharge plenum, and not delivered to the system, is received in an oil sump (the "discharge sump") located in the discharge plenum. The discharge sump and the suction plenum are in fluid communication, and oil collected in the discharge sump is urged into the suction plenum. Oil received into the suction plenum from the discharge sump tends to either mix with working fluid received into the suction plenum via the suction port or flow into the suction sump located in the suction plenum. Oil entrained in the working fluid received into the suction plenum either remains admixed with the working fluid, or separates therefrom and becomes deposited on surfaces within the suction plenum or is collected in the suction sump.

The thrust surface of the orbital scroll member is provided with an annular groove into which oil from the suction sump is received and conveyed to the thrust surface/thrust washer interface. The groove thus forms an oil distribution channel by which oil from the suction sump is conveyed to that interface, replenishes the oil pockets, and is forced between the thrust surface and the thrust washer.

The annular oil distribution channel may include a plurality of arcuate grooves or groove segments interconnected through spaces defined in the orbital scroll member that accommodate the anti-rotation mechanism of the compressor assembly. One of these spaces may be located at least partially below the surface level of oil in the suction sump, from which it receives oil that is distributed by the oil distribution channel. The spaces accommodating the anti-rotation mechanism may be toroidal and define circular tracks that move in unison with the orbital scroll member, orbitally about cylindrical members whose locations relative to the housing are fixed. The cylindrical members may be pins, or in the form of needle roller bearing assemblies disposed on the pins. The orbital movement of the circular track receiving oil from the suction sump, about its respective cylindrical member, tends to force oil received from the suction sump into at least one of a pair of groove segments interconnected through the toroidal space. Oil forced from that space into only one of the groove segments connected to the space tends to be conducted in a single circular direction through the oil distribution channel from the space. Oil forced from that space into both of the groove segments connected to the space tends to be conducted from the space in opposite directions through the oil distribution channel. Oil that is distributed by the channel to the interface between the thrust surface and the thrust washer lubricates the interfacing surfaces and replenishes the oil pockets.

During compressor operation, the buildup of oil pressure in the annular distribution channel, in part due to oil flow resistances through its groove(s) and the interface between the thrust surface and thrust washer, hydrodynamically supports the orbital scroll member axially away from the thrust washer and the rear-facing surface of the front casing. Oil leaked from between the thrust surface/thrust washer interface is recollected in the suction sump.

The present invention provides a horizontal scroll compressor assembly for compressing a working fluid and lubricated with an oil. The compressor assembly includes a housing having an axis, an interior surface, and suction and discharge ports. Located in the housing are a suction plenum for receiving working fluid substantially at a suction pressure through the suction port, a discharge plenum from which working fluid substantially at a discharge pressure is dischargeable through the discharge port, and a suction sump for collected oil. The suction sump is located in the suction plenum. A compression mechanism is disposed in the housing for compressing an admixture of working fluid and oil. The compression mechanism includes an orbital scroll member and a nonorbital scroll member, the scroll members interengaged for defining a compression chamber therebetween into which the admixture is receivable from the suction plenum for compression. The compression mechanism has a discharge aperture for passing compressed admixture from the compression chamber to the discharge plenum. The orbital scroll member has a thrust surface in axial superposition with the housing interior surface, and movement about the axis relative to the housing and the nonorbital scroll member. The thrust surface is provided with an oil distribution channel extending at least partially about the axis, and oil from the suction sump is receivable into the oil distribution channel.

Oil in the distribution channel is urged therealong and delivered to locations between the axially superposed thrust and housing interior surfaces during movement of the orbital scroll member.

In accordance with one aspect of the present invention, the compressor assembly includes a thrust washer disposed between the superposed surfaces, the thrust surface and the thrust washer having movement relative to each other. A further aspect of the present invention is that the thrust washer is provided with a plurality of apertures, the apertures and the housing interior surface defining oil pockets in which oil delivered through the oil distribution channel to locations between the superposed surfaces is deposited.

In accordance with another aspect of the present invention, in the compressor assembly the thrust surface and the housing interior surface are axially separable by hydrodynamic forces in oil delivered by the distribution channel to locations between the superposed surfaces during the movement of the orbital scroll member.

In accordance with another aspect of the present invention, in the compressor assembly the orbital scroll member is axially supportable away from the housing interior surface by hydrodynamic forces in oil delivered by the distribution channel to locations between the superposed surfaces during the movement of the orbital scroll member.

In accordance with another aspect of the present invention, the compressor assembly includes an anti-rotation mechanism through which the orbital scroll member and the housing are coupled. The orbital scroll member is provided with a plurality of spaces partially defining the anti-rotation mechanism, a lowermost one the spaces disposed in the suction sump and being receivable of oil from the suction sump; the oil distribution conduit is fluidly connected to that space. A further aspect of the present invention is that that space has at least one cylindrical surface, and the anti-rotation mechanism includes a cylindrical member disposed in that space. The cylindrical surface of that space is moved about the cylindrical member, and movement of oil in the lowermost space is induced by the anti-rotation mechanism. Oil from the suction sump receivable into that space is forced from that space into the oil distribution channel during the movement of the orbital scroll member. Furthermore, another aspect of the present invention is that that space is toroidal and has a pair of concentric cylindrical surfaces between which the cylindrical member is located. Moreover, another aspect of the present invention is that the oil distribution channel includes at least two groove segments fluidly interconnected through the toroidal space. Oil receivable into the toroidal space from the suction sump is forced into at least one of the groove segments and pumped along the oil distribution channel during the movement of the orbital scroll member. Further still, an aspect of the present invention is that the oil distribution channel includes two or more groove segments arranged about the axis, an end of one groove segment interconnected to an end of another groove segment through the toroidal space.

In accordance with another aspect of the present invention, in the compressor assembly the oil distribution channel includes an elongate groove segment. A further aspect of the present invention is that the elongate groove segment has uniformly spaced edges and a floor located therebetween. A further aspect of the present invention is also that the oil distribution channel includes a plurality of elongate groove segments, an end of one groove segment fluidly interconnected with an end of another groove segment within the orbital scroll member. An additional aspect of the present invention is that the compressor assembly includes an anti-rotation mechanism through which the housing and the orbital scroll member are coupled, and wherein the fluidly interconnected groove segment ends are interconnected through a space located in the orbital scroll member and partially defining the anti-rotation mechanism. Furthermore, another aspect of the present invention is that the space is at least partially located in the suction sump and is receivable of oil from the suction sump. Moreover, another aspect of the present invention is that the anti-rotation mechanism includes a pair of concentric cylindrical surfaces between which at least a portion of the space is located, and a cylindrical member having a fixed location about the axis relative to the housing, the cylindrical member diametrically extending between the concentric cylindrical surfaces. Movement of oil in the space is induced by relative movement between the concentric cylindrical surfaces and the cylindrical member. Oil from the suction sump receivable into the space is forced from the space and into the oil distribution channel during the movement of the orbital scroll member. Further still, an aspect of the present invention is that the cylindrical member is a needle roller bearing assembly on which at least one of the concentric cylindrical surfaces rides during the movement of the orbital scroll member.

The present invention further provides a method for distributing oil in a scroll compressor assembly including: receiving oil into an oil distribution channel located in the thrust surface of an orbital scroll member; pumping oil along the oil distribution channel to locations between the thrust surface and a superposed housing surface; and lubricating a thrust surface interface with oil pumped to locations between the thrust surface and the superposed housing surface.

In accordance with one aspect of the present invention, the method also includes supporting the orbital scroll member away from the housing surface that superposes the thrust surface with hydrodynamic forces in the oil delivered by the oil distribution channel to locations between the thrust surface and the superposed housing surface.

In accordance with another aspect of the present invention, the method also includes receiving oil from a suction sump into a space located in the thrust surface of the orbital scroll member; inducing movement to oil received in the space with a member of an anti-rotation mechanism located in the space; forcing oil received into the space from the suction sump into the oil distribution channel with the anti-rotation mechanism.

There has thus been outlined, rather broadly, certain features of an exemplary embodiment of the invention in order that the detailed description thereof may be better understood, and in order that the present contribution to the art may be better appreciated. Additional or alternative features of an embodiment of the invention are described in further detail below. Before explaining an embodiment of the invention in detail, however, it is to be understood that the invention is not limited in its application to the details of construction and to the arrangement of the components described above or set forth in the following detailed description of the best mode of the invention illustrated in the drawings. The invention is capable of other embodiments and of being practiced and carried out in various ways. Also, it is to be understood that the phraseology and terminology employed herein are for the purpose of description and should not be regarded as limiting.

BRIEF DESCRIPTION OF THE DRAWINGS

The various objects, features and attendant advantages of the present invention will become fully appreciated as the same becomes better understood when considered in conjunction with the accompanying drawings. It is to be noted that the accompanying drawings are not necessarily drawn to scale or to the same scale; in particular, the scale of some of the elements of the drawings may be exaggerated to emphasize characteristics of the elements. Moreover, like reference characters designate the same, similar or corresponding parts throughout the several views, wherein.

Figure 1:
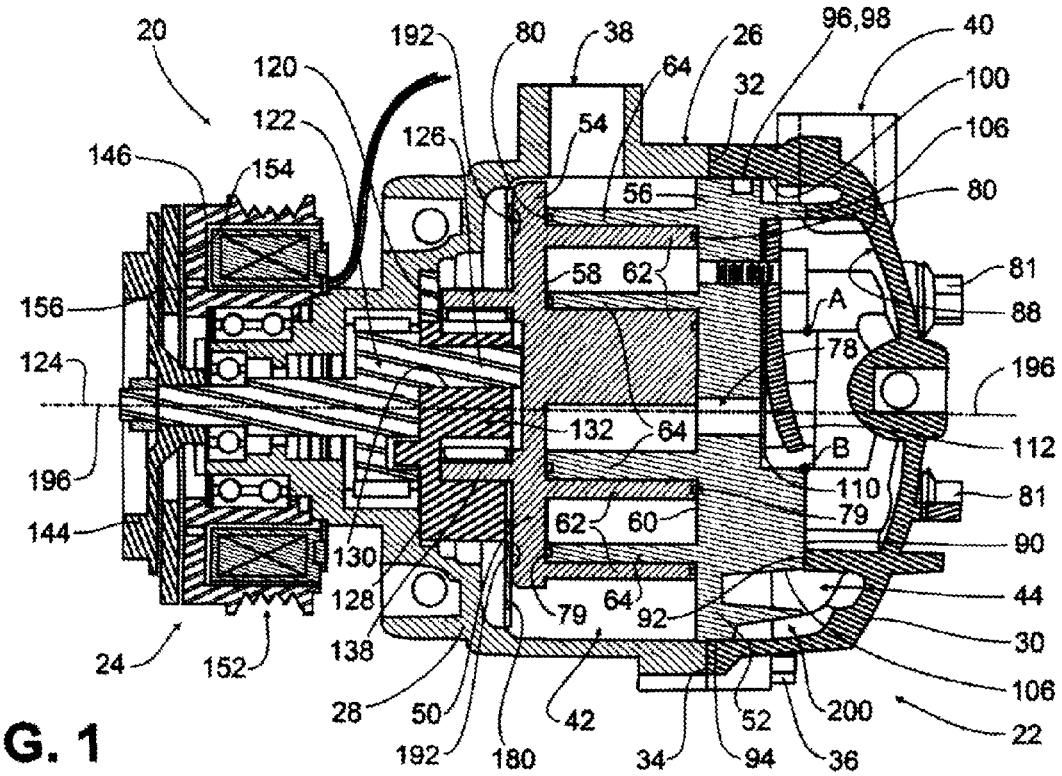
FIG. 1 is a cross-sectioned side view of an embodiment of a scroll compressor and clutch assembly according to the present invention shown in an operating orientation.

The invention is susceptible to various modifications and alternative forms, and the specific embodiment thereof shown by way of example in the drawings is herein described in detail. It should be understood, however, that the drawings and detailed description are not intended to limit the invention to the particular form disclosed, but on the contrary, the intention is to cover all modifications, equivalents and alternatives falling within the spirit and scope of the present invention as defined by the appended claims.

DETAILED DESCRIPTION OF AN EXEMPLARY EMBODIMENT

The compressor and clutch assembly 20 shown in FIG. 1 includes a scroll-type compressor assembly 22 and an attached clutch assembly 24. The scroll compressor assembly 22 includes a generally cylindrical compressor housing 26 having inter-sealed front and rear casings 28 and 30 that are parts of the housing. Generally, axial and radial directions mentioned herein are with reference to the housing 26. The front and rear casings 28 and 30 are respectively provided with mating surfaces 32 and 34, and are affixed to each other by bolts 36 to define the housing 26. A compressor fluid inlet or suction port 38 and a compressor fluid outlet or discharge port 40 are provided in the housing 26. During compressor operation, a compressible working fluid, such as a refrigerant gas, is received at a suction pressure by the suction port 38, and is expelled a relatively higher, discharge pressure from the discharge port 40. The magnitudes of the suction and discharge pressures, and the differentials therebetween, vary considerably with different system operating conditions.

The compressor housing 26 is axially divided into a suction plenum 42 in fluid communication with the suction port 38, and a discharge plenum 44 in fluid communication with the discharge port 40. As used herein, "fluid communication" is understood to mean that the uninterrupted flow of a gas or liquid is facilitated between elements said to be in fluid communication.

Figure 7:
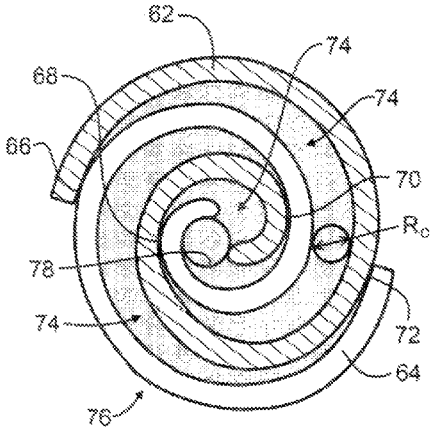
FIG. 7 is a partial, cross-sectioned front view of the interleaved orbital and nonorbital scroll members.

An orbital scroll member 50 and a nonorbital scroll member 52 are interengaged and mounted within the housing 26. The scroll members 50 and 52 include end plates 54 and 56 with parallel, interfacing, flat, inner surfaces 58 and 60, and involute wraps 62 and 64 extending therefrom, respectively. The involute wraps 62 and 64 are intermeshed and contact each other along contact lines 66, 68, 70 and 72 and the adjacent inner surfaces 58 and 60 to form closed fluid pockets or compression chambers 74 of variable volume, as shown in FIG. 7. The interengaged scroll members 50, 52 thus define a compression mechanism 76. Compressed fluid is expelled from the compression mechanism 76 via a passageway 78, such as a discharge aperture 78, centrally located in the nonorbital scroll member 52.

As shown, tip seal grooves 79 may be provided in the scroll wraps 62, 64 and have axial tip seals 80 which float therein. The tip seals 80 slidably engage the inner surfaces 58, 60 of the scroll members 50, 52. The tip seals 80 also improve compressor efficiency, and accommodate the differences in thermal expansion between the radially inner portions of the involute wraps 62 and 64 where temperatures are highest during compressor operation and at their radially outer portions where temperatures are lowest during compressor operation. Further, the tip seals 80 accommodate a small amount of axial movement between the scroll members 50, 52. Typically, the tip seals 80 also reduce wear and improve sealing between the axial tips of the involute wraps 62 and 64 and flat surfaces 58 and 60 on end plates 54 and 56.

Within the housing 26, the nonorbital scroll member 52 is secured to the rear casing 30 with bolts 81 extending through clearance holes 82 in the rear casing 30 and threaded into corresponding blind, tapped holes 84 provided in the rear face 86 of the nonorbital scroll member 52, which is opposite the flat surface 60 of its end plate 54. The discharge plenum 44 is sealed relative to the clearance holes 82. The nonorbital scroll member rear face 86 and the interfacing, interior surface 88 of the rear casing 30 are provided with axially projecting bosses which define abutment surfaces 90 and 92 brought into compressive engagement directly or through an intermediate gasket (not shown) when the bolts 81 are tightened.

The cylindrical outer peripheral surface 94 of the nonorbital scroll member 52 is provided with circumferential grooves 96 in which o-ring seals 98 are disposed. The seals 98 are engaged with the mating, cylindrical, inner peripheral surface 100 of the rear casing 30 that radially interfaces the nonorbital scroll member surface 94. Thus, the nonorbital scroll member 52 is fixed relative to the housing 26 and, with the front and rear casings 28, 30 assembled, the nonorbital scroll member 52 axially partitions or separates the housing 26 into the suction plenum 42 and the discharge plenum 44.

It can thus be understood that: during compressor operation the suction plenum 42 contains working fluid at substantially suction pressure and the discharge plenum 44 contains working fluid at substantially discharge pressure; the suction plenum 42 is in fluid communication with the compressor suction port 38 and the inlet to the compression mechanism 76, and the discharge plenum 44 is in fluid communication with the compressor discharge port 40; and the fluid entering the inlet of the compression mechanism 76 is captured in the compression chambers 74 defined by the interleaved wraps 62, 64 of the scroll members 50, 52 during their relative movements, compressed, and discharged from the compression mechanism 76 into the discharge plenum 44 via the passageway defined by the discharge aperture 78.

Figure 3:
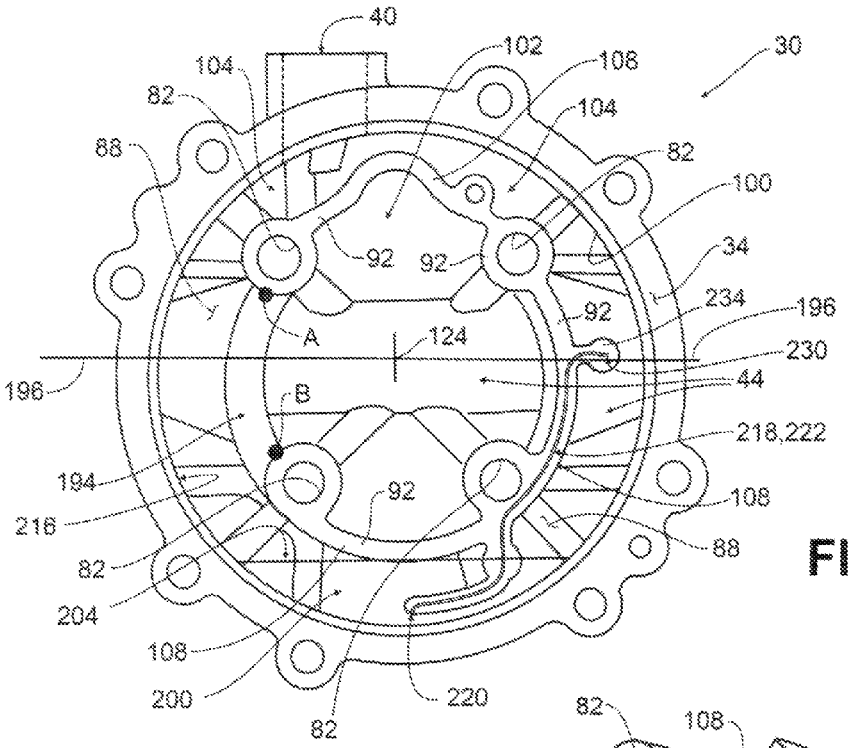
FIG. 3 is a front view of the rear casing of the scroll compressor assembly.
Figure 4:
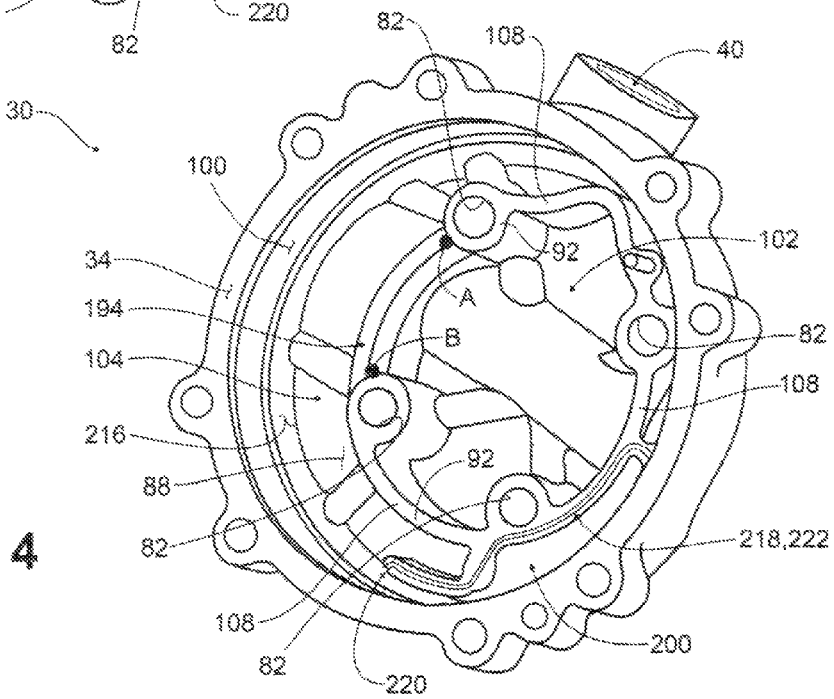
FIG. 4 is a front perspective view of the rear casing of FIG. 3.
Figure 5:
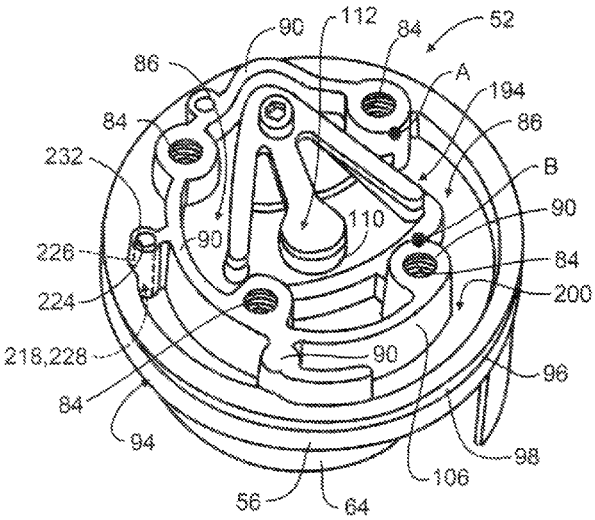
FIG. 5 is a rear perspective view of the nonorbital scroll member of the scroll compressor assembly.

The discharge plenum 44 in the depicted embodiment defines a radially central discharge chamber 102, into which is received the working fluid/oil admixture compressed by the compression mechanism 76, and a radially surrounding exhaust chamber 104. Referring to FIGS. 3 through 5, the axially projecting bosses of the rear face 86 of the nonorbital scroll member 52 and the front-facing interior surface 88 of the rear casing 30 define a mating pair of continuous, C-shaped walls 106 and 108 which axially abut and together partially enclose the generally cylindrical discharge chamber 102. The C-shaped walls 106 and 108 axially abut directly or through an intermediate gasket (not shown). A reed-type check valve 110 is employed to prevent the backflow of compressed fluid from the discharge plenum 44 into the compression mechanism 76 through the passageway defined by the discharge aperture 78. In the depicted embodiment, the reed valve 110 is mounted on the rear face 86 of the end plate 56 of the nonorbital scroll member 52. A ramped valve stop 112 attached to the nonorbital scroll member 52 limits the opening movement of the valve 110. Alternatively, the valve stop 112 may be formed on a boss (not shown) projecting from the front-facing interior surface 88 of the rear casing 30 within the discharge chamber 102.

The scroll compressor assembly 22 has an orbital scroll member drive assembly 120 that includes a drive shaft 122, such as the depicted crankshaft 122, journaled in the front casing 28 for rotation about a shaft rotation axis 124, which extends axially relative to the housing 26. The crankshaft 122 has a cylindrical stub shaft portion 126 that revolves about the shaft rotation axis 124. The centerline of the stub shaft portion 126 is parallel with and offset from the shaft rotation axis 124. A cylindrical, inertial balance weight 128 is mounted to the crankshaft 122, and has a through bore 130 extending between its axially opposite ends into which the stub shaft portion 126 extends. The crankshaft 122 and the balance weight 128 are cooperatively interfitted such that the balance weight 128 rotates with the crankshaft 122 about the shaft rotation axis 124. The outer cylindrical surface of the balance weight 128 defines a cylindrical crank 132 having a centerline axis 134 that revolves in a circular orbit about the shaft rotation axis 124. The crank axis 134 is parallel with and offset from the shaft rotation axis 124. The axes 124 and 134 are offset by a distance equal to the orbit radius $R_o$, of the orbital scroll member 50 relative to the nonorbital scroll member 52. The cylindrical crank 132 is received in, and is rotatably coupled through a bearing 136 to, a cylindrical hub 138 centrally-located on and extending from the front face 140 of the orbital scroll member end plate 54. The cylindrical, central hub 138 is an integral part of the orbital scroll member 50, and is concentric with the cylindrical crank 132 about the axis 134. Thus, the axis 134 is the central axis of both the crank 132 and the hub 138. Rotation of the crankshaft 122 thus imparts orbital motion to the orbital scroll member 50 about the shaft rotation axis 124 at orbit radius $R_o$.

The crankshaft 122 extends forward along the shaft rotation axis 124, away from the compression mechanism 76 to its front end 142, and out of the suction plenum 42 through the front casing 28, so that the front end 142 can be coupled to and driven by a rotative power source (not shown) through the clutch assembly 24. In a well-known manner, the crankshaft 122 and the front casing 28 are mutually sealed against working fluid and oil leakage from the compressor housing 26 by a shaft seal disposed about the crankshaft 122.

Figure 2:
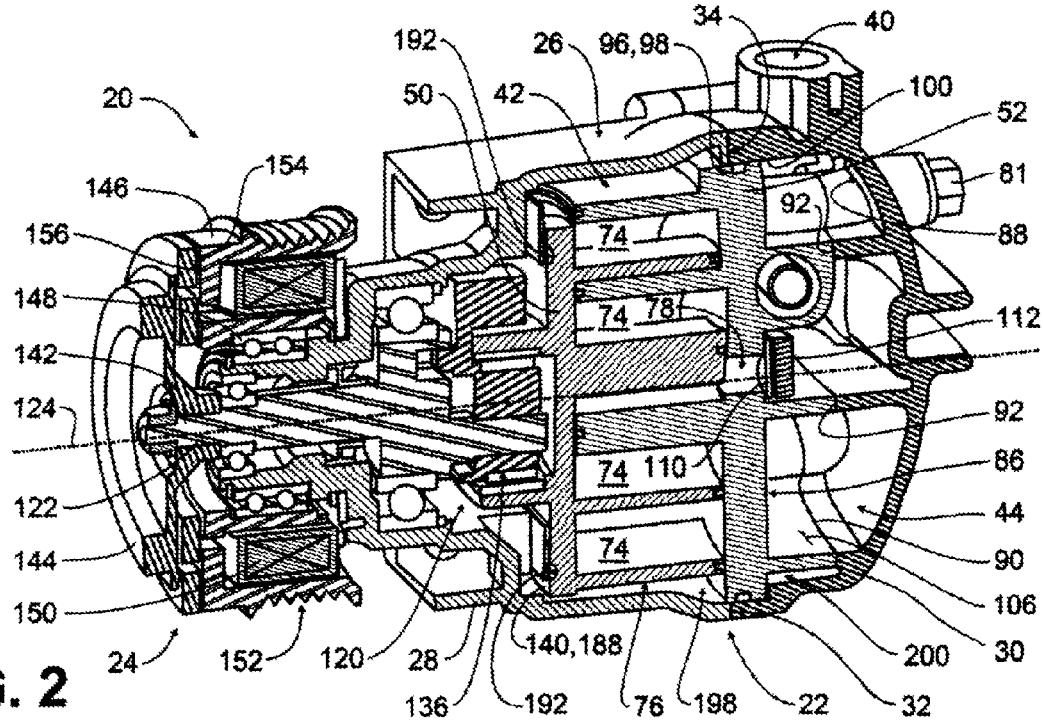
FIG. 2 is a cross-sectioned perspective view of the scroll compressor and clutch assembly.

Referring to FIG. 2, the clutch assembly 24 includes a clutch hub assembly 144 rotatably fixed to the crankshaft front end 142, a pulley assembly 146 having a bearing 148 rotatably mounted to the front casing 28, and a selectively energizable electromagnetic coil assembly 150 affixed to the front casing 28. The clutch hub assembly 144 and the pulley assembly 146 are rotatable about the axis 124. The toroidal coil assembly 150 is generally centered about the axis 124 and surrounds the pulley bearing 148. The coil assembly 150 is itself surrounded by the sheave 152 of the pulley assembly 146. With the compressor and clutch assembly 20 operatively installed, the rotative power source (e.g., the engine crankshaft pulley, not shown) is continuously coupled to the pulley assembly 146 via a drive belt (not shown) that engages the pulley sheave 152. Movement of the drive belt drivingly rotates the pulley assembly 146 about the axis 124 relative to the compressor housing 26.

The clutch assembly 24 is biased into a disengaged state when the coil assembly 150 is nonenergized. In the disengaged state, the clutch hub assembly 144 is elastically biased into a position in which its rear-facing clutch surface 154 is spaced from the front-facing clutch surface 156 of the pulley assembly 146. The location of clutch surface 156 is generally fixed axially relative to the housing 26. In the disengaged state, the clutch hub assembly 144 and the pulley assembly 146 are uncoupled, and the shaft 122 is not driven. When the coil assembly 150 is electrically energized, the clutch assembly 24 is brought into its engaged state, in which the clutch surface 154 of the clutch hub assembly 144 is electromagnetically forced against its bias and into contact with the clutch surface 156 of the pulley assembly 146. In the engaged state of the clutch assembly 24, the interfacing clutch surfaces 154 and 156 are frictionally coupled for rotation in unison about the axis 124, thereby operably coupling the rotative power source and the compressor drive shaft 122 for driving the compression mechanism 76.

An anti-rotation mechanism 160 is mounted to and couples the front casing 28 and the orbital scroll member 50. The anti-rotation mechanism 160 of the scroll compressor assembly 22 is similar to that disclosed in above-mentioned U.S. Pat. No. 5,346,376 except as herein described. The anti-rotation mechanism 160 prevents rotation of the orbital scroll member 50 relative to the housing 26 while allowing the orbital scroll member 50 to move orbitally relative to the nonorbital scroll member 52 about the shaft rotation axis 124. The orbital scroll member 50 moves with the crank 132 and thus moves relative to the nonorbital scroll member 52 in a circular orbit about the shaft rotation axis 124. The distance of the relative orbital movement of the interleaved wraps 62, 64 is at radius Ro. The interleaved wraps 62, 64 define, and then reduce the volume of, the compression chambers 74 as the compression chambers 74 move away from the inlet of the compression mechanism 76 and toward the central discharge aperture 78 located in the nonorbital scroll member 52.

Figure 8A:
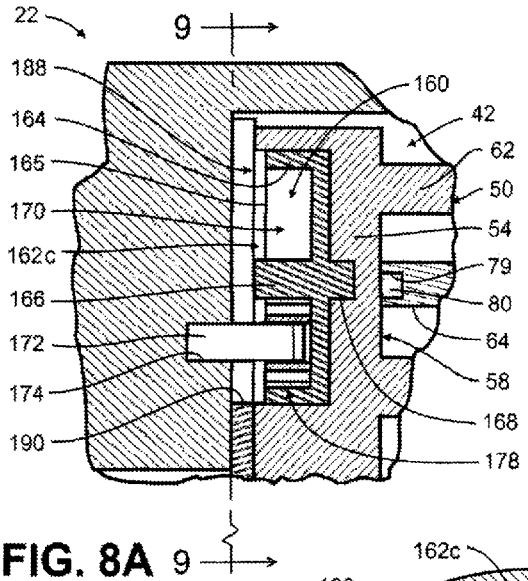
FIG. 8A is a fragmentary, cross-sectioned side view of the front casing and orbital scroll member, showing part of the anti-rotation mechanism of the scroll compressor assembly.
Figure 8B:
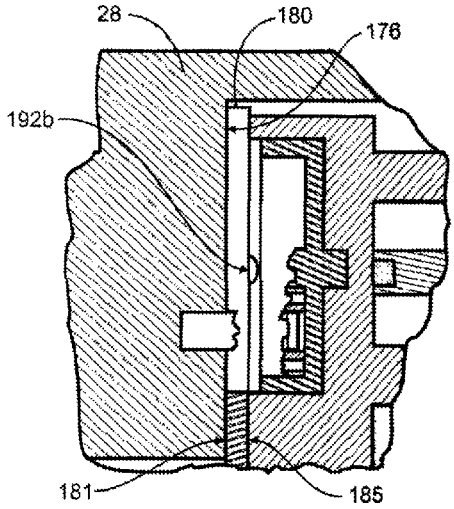
FIG. 8B is substantially identical to FIG. 8A, but with a portion of the depicted part of the anti-rotation mechanism partially broken away.

The anti-rotation mechanism 160 includes a plurality of large, blind, first bores 162 in the front face 140 of the orbital scroll member 50 that are spaced radially outboard of the hub 138 and open toward the front casing 28. In the depicted embodiment, four such first bores 162, designated first bores 162*a*, 162*b*, 162*c*, and 162*d*, are included, and are circumferentially spaced equidistantly about the orbiting scroll member hub 138, at a common radial distance from the hub's central axis 134, which coincides with the crank axis 134. As shown, one of these first bores 162 is positioned vertically below the others in the operating orientation of the scroll compressor assembly 22. In the depicted embodiment, first bore 162*a* is so positioned and remains located substantially directly below the crank axis 134 throughout rotation of the crankshaft 122 in the operating orientation. A cup 164 is pressed into and seated against the bottom of each blind first bore 162. Each cup 164 has a circular edge or rim 165 that is spaced from the orbital scroll member front face 140 within the respective first bore 162, as best seen in FIGS. 8A and 8B. A first pin 166 is pressed through an opening in the center of each cup 164 and into a blind second bore 168 in the orbital scroll member 50. Each second bore 168 is concentric with its respective first bore 162 and has a relatively smaller diameter. Alternatively, each first pin 166 could be an integral part of its cup 164, as shown. The first pins 166 and the cups 164 have concentric cylindrical surfaces that cooperate to define a toroidal space 170 in each first bore 162. Each toroidal space 170 defines a circular track 170 about its respective first pin 166.

Second pins 172 are pressed into mating, blind, third bores 174 in the planar rear-facing surface 176 of the front casing 28, which superposes the orbital scroll member front face 140. Each of the third bores 174 corresponds to one of the first bores 162 in the orbital scroll member 50. Each cylindrical second pin 172 has an axis parallel with shaft axis 124 and defines a cylindrical member 172 that extends into a respective toroidal space 170. The diameter of each second pin 172, or at least of the portion of it that projects into space 170, may be such that it extends substantially between the concentric cylindrical surfaces of the first pins 166 and the cups 164. Optionally, a hollow cylindrical member such as a needle roller bearing assembly 178 having an axis parallel with the shaft axis 124 may be pressed onto the end of each second pin 172, as shown. In the depicted embodiment, each roller bearing assembly 178 is received in a respective toroidal space 170, with bearing outer diameter substantially extending between the concentric cylindrical surfaces of the first pin 166 and the cup 164.

Relative to the orbital scroll member 50, the second pin 172 and, if present, its optional needle roller bearing assembly 178 received within each first bore 162 orbits in a circle defined by the toroidal space 170 inside of its cup 164, and about its first pin 166. Thus, relative to the housing 26, the first pin 166 within each cup 164 moves in a circular orbit about the circumference of the respective cylindrical member (i.e., about the second pin 172 or its optional roller bearing assembly 178) disposed in the respective circular track 170. These circular orbits are substantially equivalent to the distance of the orbit radius Ro. The cylindrical inner peripheral surface of each cup 164 thus rides on the outer circumference of the respective cylindrical member disposed therein, such as a portion of a second pin 172 projecting from housing front casing surface 176, or a needle roller bearing assembly 178 rotatably mounted about a second pin 172 as shown.

A thrust washer 180 is mounted on the rear-facing surface 176 of the front casing 28. The thrust washer 180 is disposed between the axially superposed surfaces of the orbital scroll member front face 140 and the front casing 28. The thrust washer 180 of the scroll compressor assembly 22 is similar to that disclosed in above-mentioned U.S. Pat. No. 5,346,376. The planar thrust washer 180 has parallel, opposite sides and is preferably made from a steel stamping. The front-facing side surface 181 of the thrust washer 180 abuts the rear-facing surface 176 of the front casing 28, thereby preventing frontward movement of the thrust washer 180 within the housing 26. Fasteners such as third pins 182 are pressed through first apertures 184 in the thrust washer 180 and into mating, blind bores (not shown) in the rear-facing surface 176 of the front casing 28, thereby fixing the position of the thrust washer 180 relative to the housing 26. The exposed ends of the third pins 182 are flush with or recessed relative to the rear-facing side surface 185 of the thrust washer 180. Additionally, several second apertures 186 are provided in the thrust washer 180. The second apertures 186 cooperate with the planar rear-facing surface 176 of the front casing 28 to define a plurality of oil pockets 187 which are open towards the planar, front-facing thrust surface 188 of the orbital scroll member front face 140, which superposes the rear-facing interior surface 176 of the housing 26. These oil pockets 187 contain quantities of the substantially incompressible oil that lubricate the sliding interface between the orbital scroll member thrust surface 188 and the rear-facing thrust washer surface 185. The thrust washer 180 may also be coated with a low friction material on at least its rear-facing surface 185. Abutment between the front-facing thrust surface 188 of the orbital scroll member 50, and the rear-facing surface 185 of the thrust washer 180, limits forward axial movement of the orbital scroll member 50 away from the nonorbital scroll member 52. The thrust washer 180 is also provided with circumferentially-distributed notches 190 in which the cylindrical members (e.g., the needle roller bearing assemblies 178 and/or the second pins 172) are disposed.

Figure 6:
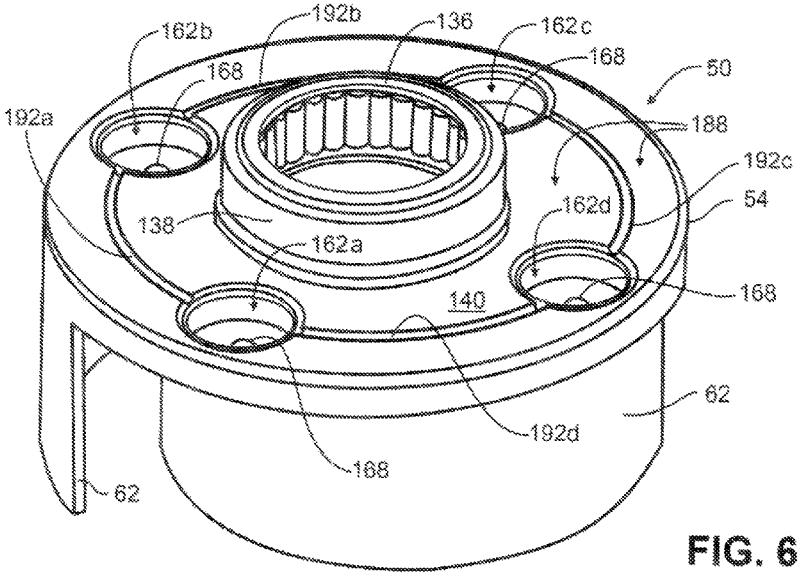
FIG. 6 is a front perspective view of the orbital scroll member of the scroll compressor assembly, with its anti-rotation mechanism components omitted, and showing its oil distribution channel segments.
Figure 9:
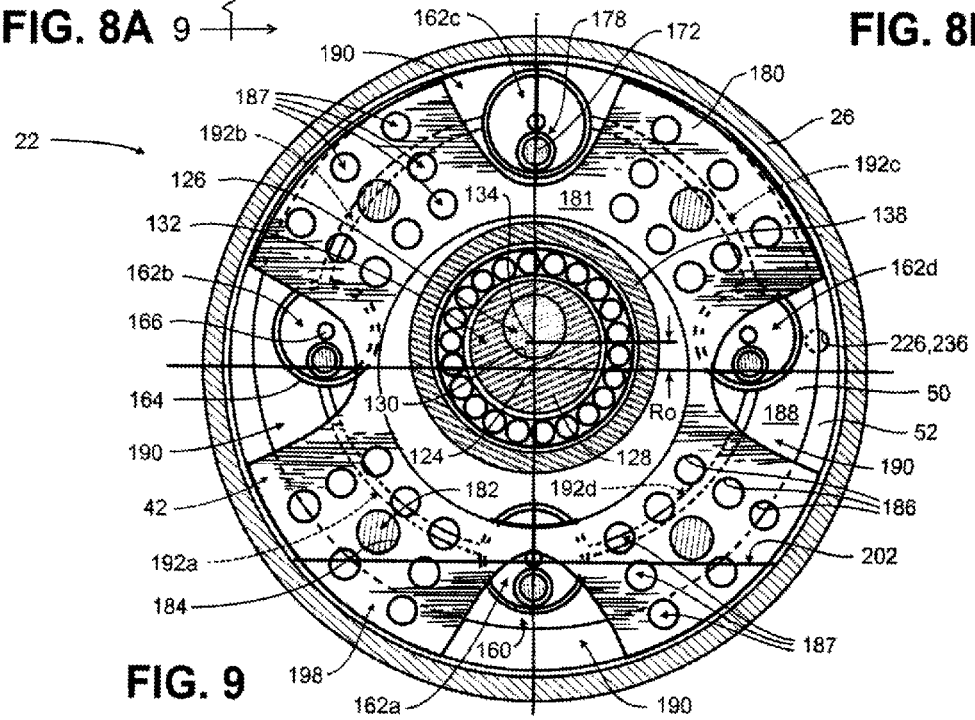
FIG. 9 is a partial, cross-sectioned front view of the compressor assembly in an operating orientation along line 9-9 of FIG. 8A, showing the oil distribution channel segments of the orbital scroll member.

Referring to FIG. 6, the thrust surface 188 of the orbital scroll member 50 is provided with an annular groove or oil distribution channel 192 located about the hub 138. In the depicted embodiment, the groove 192 is circular, and centered about the hub axis 134. In the depicted embodiment, the annular groove 192 is formed of a plurality of elongate arcuate grooves or groove segments 192*a*, 192*b*, 192*c*, and 192*d* arranged in a circle, with their adjacent ends respectively interconnected through the first bores 162*a*, 162*b*, 162*c*, and 162*d*, as shown in FIGS. 6 and 9.

In the depicted embodiment, each arcuate groove segment 192*a*-192*d* is of uniform width radially, and open at the thrust surface 188. Each groove segment 192*a*-192*d* may also be of uniform depth from the planar thrust surface 188. Alternatively, the groove segments 192 may have nonuniform width (s) and/or depth(s). At its juncture with a first bore 162, the floor of each groove segment 192*a*-192*d*, located between its radially spaced sides or edges, is preferably at the same distance or less from the thrust surface 188 than the rims 165 of the cups 164 are, as best shown in FIG. 8B. Thus, with the cups 164 and first pins 166 installed in the first and second bores 162, 168, the arcuate groove segments 192*a*-192*d* are interconnected through the toroidal spaces 170 which accommodate the anti-rotation mechanism 160.

Although groove 192 is shown as including separate, arcuate grooves or groove segments 192*a*-192*d* intersecting the toroidal spaces 170 of the anti-rotation mechanism 160, the oil distribution channel 192 may itself be continuous along its entire length as shown. Alternatively, the oil distribution channel 192 may be non-annular. Further, although the circular distribution channel 192 of the depicted embodiment is endless, it is envisioned that in certain embodiments, the channel 192 may extend between opposite terminal ends thereof that are not joined to each other directly indirectly in the orbital scroll member 50, such as through an intermediate first bore 162.

During compressor operation, compressed fluid at substantially discharge pressure and containing an entrained quantity of lubricating oil is expelled from the fluid pockets or compression chambers 74 of the compression mechanism 76 through the passageway or discharge aperture 78 in the nonorbital scroll member 52, past discharge reed valve 110, and into the discharge chamber 102. The compressed working fluid/oil admixture flows from the discharge chamber 102 via a discharge chamber outlet or passage 194 located between the circumferential ends of the axially-stacked, C-shaped walls 106 and 108 that together define the continuous side wall of the discharge chamber 102. These circumferential wall ends are indicated by points A and B in FIGS. 3-5. Points A and points B of the rear casing 30 and of the nonorbital scroll member 52 respectively coincide when these components are assembled together, thereby defining points A and B of the scroll compressor assembly discharge plenum 44. The circumferentially elongate discharge chamber outlet 194 thus extends between discharge plenum points A and B. In other words, the discharge and exhaust chambers 102 and 104 are in fluid communication with each other through the passage 194 located between the discharge plenum points A and B.

In scroll compressor assembly 22, the shaft rotation axis 124 lies in an imaginary plane 196; the plane 196 is preferably positioned between discharge plenum points A and B. When operatively installed, compressor assemblies used in automotive refrigeration systems typically have a belt-driven drive shaft axis of rotation that extends in a generally horizontal direction; they are thus known as horizontal compressor assemblies. In its preferred mounting configuration and operating orientation, the shaft rotation axis 124 and the plane 196 of the scroll compressor assembly 22 are generally horizontal. In other words, the plane 196 of the operatively installed compressor assembly 22 is generally horizontal and preferably positioned between points A and B, within the passage 194 that extends between the discharge and exhaust chambers 102, 104, as can be understood with reference to FIG. 3. It can thus be understood that the scroll compressor assembly 22 is an embodiment of a horizontal scroll compressor assembly. Moreover, the discharge port 40 is preferably positioned vertically above the generally horizontal plane 196 when the compressor assembly 22 is in its operating orientation.

Oil sumps 198 and 200 are respectively located in the suction and discharge plenums 42 and 44. The oil sump 198 located in the suction plenum 42, and the oil sump 200 located in the discharge plenum 44, are also referred to herein as the suction sump 198 and the discharge sump 200, respectively. Normally, the respective oil surface levels 202 and 204 of these oil sumps are both located vertically below the plane 196 during compressor operation, as respectively indicated in FIGS. 9 and 3. Those of ordinary skill in the art will recognize that during compressor operation the oil deposited in the suction sump 198 is under substantially suction pressure, and the oil deposited in the discharge sump 200 is under relatively higher, substantially discharge pressure. They will also recognize that their respective oil surface levels 202 and 204 will vary with differing system operating conditions.

Oil separated from the working fluid as a result of the compressed admixture contacting compressor assembly surfaces in the discharge plenum 44 is collected in the discharge sump 200. For example, with reference to FIGS. 3 and 4, the working fluid/oil admixture expelled from the discharge chamber 102 through the outlet or passage 194 will impact the interior side wall surface 216 of the housing 26 in the exhaust chamber 104, causing a portion of the entrained oil to separate from the working fluid and collect on the side wall surface 216. Oil collected on the interior side wall surface 216 flows downwardly therealong, primarily under the force of gravity, and is received into the region of the exhaust chamber 104 containing the discharge sump 200.

Lubricating oil collected in the discharge sump 200, which is under substantially discharge pressure, is conveyed from the discharge sump 200 to the suction plenum 42, within the compressor housing 26, through an oil return conduit 218. The discharge plenum 44 and the suction plenum 42 are in fluid communication internally of the scroll compressor assembly 22 through the oil return conduit 218. During compressor operation, oil flow through the oil return conduit 218 is continuous, but restricted by a length and/or a cross-sectional size of the conduit 218. The oil flow through the oil return conduit 218 is urged by the pressure differential between the suction and discharge plenums 42 and 44, i.e., between substantially discharge and substantially suction pressures.

The oil return conduit 218 has an inlet 220 opening into the discharge sump 200 at a location normally below the surface level 204 of the oil pooled therein. The oil return conduit 218 has a first leg or first portion 222 that extends from the conduit inlet 220 to the entrance 224 of an oil return bore 226. The oil return bore 226 extends axially through the nonorbital scroll member 52, as best seen in FIG. 5.

The first leg 222 of the oil return conduit 218 may be defined by a groove 222 formed in one or the other, or both, of a pair of the axially abutting surfaces 90, 92 of bosses projecting from the rear face 86 of the nonorbital scroll member 52 and the interfacing interior surface 88 of the rear casing 30. Alternatively, the first leg 222 of the oil return conduit 218 may be defined by an elongate slot extending through the axial thickness of a gasket (not shown) sandwiched between that pair of axially abutting boss surfaces 90, 92. Alternatively, the first leg 222 may be defined by one or a plurality of intersecting bores (not shown) extending through one of these abutting bosses. In the depicted embodiment, a first leg-defining groove 222 is formed in portions of the axial abutment surface 92 of a boss projecting from the interior, front-facing surface 88 of the rear casing 30, as shown in FIGS. 3 and 4.

The oil return bore 226 extending through nonorbital scroll member 52 defines a second leg or second portion 228 of the oil return conduit 218 that has a minimal cross-sectional size larger than that of the conduit first leg 222. The terminal end 230 of the first leg groove 222, shown in FIG. 3, is located within an area bounded by the circumference of the oil return bore entrance 224. Referring to FIGS. 3 and 5, the entrance 224 to the oil return bore 226 is located in a portion 232 (FIG. 5) of the abutment surface 90 of the nonorbital scroll member 52, and that surface portion 232 is superposed by a portion 234 (FIG. 3) of the abutment surface 92 of the rear casing 30 in which the terminal end 230 of the conduit first leg groove 222 is located. Thus, the first and second legs 222, 228 of the oil return conduit 218 are in fluid communication with each other, and the oil return conduit 218 is sealed along its overall length from the discharge plenum 44.

Referring to FIG. 9, the exit 236 of the oil return bore 226, which is located axially opposite its entrance 224, is open to the suction plenum 42 at a location normally above the oil surface level 202 of the suction sump 198. During compressor operation, oil received into the suction plenum 42 via the oil return conduit 218 tends to flow under the influence of gravity toward the suction sump 198, in which it is received and held at substantially suction pressure.

Oil which is not separated from the compressed working fluid in the discharge plenum 44 exits the compressor assembly 22 through the discharge port 40 as part of the working fluid/oil admixture at a discharge pressure, and is directed to the remainder of the refrigerant system. Normally, portions of the oil carried in the admixture discharged from the compressor assembly 22 are separated and remixed with the working fluid in the refrigerant system, at locations upstream of the compressor assembly 22. Eventually, oil discharged from the compressor assembly 22 in a compressed working fluid/oil admixture returns to the compressor assembly entrained in working fluid received at a suction pressure through suction port 38.

Within the suction plenum 42, oil in the admixture received via the suction port 38 may also separate from the working fluid as a result of the admixture contacting surfaces within the suction plenum, and be received into the suction sump 198. A portion of the entrained oil received into the suction plenum 42 via the suction port 38, or oil returned to the suction plenum 42 via the oil return conduit 218 and remixed with working fluid at substantially suction pressure, is drawn into the inlet of the compression mechanism 76 and discharged via the passageway 78 into the discharge plenum 44.

Oil disposed in the suction sump 198 that does not become admixed with working fluid in the suction plenum 42 is partly distributed within the suction plenum 42. This oil may be distributed by being sloshed, or splashed or carried or pumped by movement of the orbital scroll member 50 in its circular orbit about the shaft rotation axis 124. The distributed oil becomes deposited on surfaces in the suction plenum 42, in the oil pockets 187, and between the thrust surface 188 and the interfacing surface 185 of the thrust washer 180.

The oil distribution channel 192 better ensures that oil is distributed between the thrust surface 188 and the thrust washer 180, and replenished to the oil pockets 187. The oil introduced to the distribution channel 192 from the suction sump 198 and/or the space 170 in lowermost first bore 162*a* is urged therealong under the influence of pumping action, and urged outwardly of the groove 192 into the pockets 187 and between the thrust surface 188 and the thrust washer surface 185. A lower portion of the groove 192 receives from the suction sump 198 oil that is distributed by the oil distribution channel 192. Referring to FIG. 9, in the depicted embodiment, the ends of the groove segments 192*a* and 192*d* open into the toroidal space defining the circular track 170 within the first bore 162*a*. At least a portion of the toroidal space 170 is located within the suction sump 198. The orbital movement of the lowermost circular track 170 about its shown needle bearing assembly 178 tends to force oil received from the suction sump 198 into the toroidal space 170 within first bore 162*a*, into at least one of the groove segments 192*a* and 192*d*, thereby urging oil received into the oil distribution channel 192 along the oil distribution channel. Under certain operating conditions, oil may be forced from this lowermost toroidal space 170 into only one of the groove segments 192*a* and 192*d*, whereby the oil received into the oil distribution channel 192 is urged to flow in a single direction therealong. Under other operating conditions, oil may be forced from the lowermost space 170 into both of the groove segments 192*a* and 192*d*, whereby the oil received into the oil distribution channel 192 is urged to flow in opposite directions therealong. Additionally, the lower portions of groove segments 192*a* and/or 192*d* may, under some operating conditions, extend below the suction sump oil surface level 202 and thus become open to receive oil from the suction sump 198 directly therein, rather than receive it solely from the lowermost toroidal space 170.

Whether oil from the suction sump 198 is urged to flow to the upper reaches of the oil distribution channel 192 via one or both of the groove segments 192*a* and 192*d* during compressor operation is thought to depend in part on the depth of the oil in the suction sump 198. An oil surface level 202 high enough to immerse most of the cylindrical member, e.g., depicted needle bearing assembly 178, is expected to facilitate the pumping of oil received by the space 170 within the first bore 162*a* from the suction sump 198 along both of the groove segments 192*a* and 192*d*; whereas an oil surface level oil high enough to immerse only a minor portion of the cylindrical member is expected to facilitate the pumping of the oil primarily into and along only one of the groove segments 192*a* and 192*d*, in which case oil will be urged along a path defined by the serially arranged groove segments 192*a*-192*d* that define the oil distribution channel 192.

It can thus be understood that oil is delivered to the interface between the orbital scroll member thrust surface 188 and the thrust washer surface 185, at locations between the axially superposed orbital scroll member front face 140 and housing rear-facing interior surface 176, and the delivered oil lubricates the interfacing surfaces 188, 185 and replenishes the oil pockets 187. Moreover, during compressor operation, pressure in the oil being delivered to locations between the axially superposed surfaces 176 and 188 via the distribution channel 192 is built up, in part due to oil flow resistances through the groove segments 192*a*-192*d*, and along the interface between the slightly axially spaced thrust washer surface 185 and thrust surface 188. This increase in pressure of the delivered oil induces hydrodynamic forces that act to separate the interfacing surfaces 185 and 188, and support the orbital scroll member 50 axially away from the thrust washer 180 and the rear-facing surface 176 of the front casing 28. As the oil which lubricates and separates surfaces 185 and 188 leaks from between their interface, it is recollected in the suction sump 198.

The foregoing description of the best mode for carrying out the invention is considered as illustrative of principles of the invention. It will be understood by those of ordinary skill in the art that modifications to the described embodiment can be made that are within the scope of the invention.

As to a further discussion of the manner of usage and operation of the present invention, the same should be apparent from the above description. With respect to the above description then, it is to be realized that the optimum dimensional relationships for the parts of the invention, to include variations in size, materials, shape, form, function and manner of operation, assembly and use, are deemed readily apparent and obvious to those of ordinary skill in the art, and all equivalent relationships to those illustrated in the drawings and described in the specification are intended to be encompassed by the present invention.

What is claimed is:

1. A horizontal scroll compressor assembly for compressing a working fluid and lubricated with an oil, comprising:

a housing having an axis, an interior surface, and suction and discharge ports, and in which are located a suction plenum for receiving working fluid substantially at a suction pressure through said suction port, a discharge plenum from which working fluid substantially at a discharge pressure is dischargeable through the discharge port, and a suction sump for collected oil, the suction sump located in the suction plenum; and a compression mechanism disposed in the housing for compressing an admixture of working fluid and oil, the compression mechanism comprising an orbital scroll member and a nonorbital scroll member, the scroll members interengaged for defining a compression chamber therebetween into which the admixture is receivable from the suction plenum for compression, the compression mechanism having a discharge aperture for passing compressed admixture from the compression chamber to the discharge plenum, the orbital scroll member having a thrust surface, the thrust surface and the housing interior surface axially superposed, the orbital scroll member having movement about the axis relative to the housing and the nonorbital scroll member, the thrust surface having a groove forming an oil distribution channel extending at least partially about the axis, an anti-rotation mechanism through which the orbital scroll member and the housing are coupled, the orbital scroll member provided with a plurality of spaces circumferentially distributed on the orbital scroll member and partially defining the anti-rotation mechanism, a lowermost one of the spaces disposed in the suction sump and directly receivable of oil from the suction sump, the oil distribution channel fluidly connecting the lowermost one of the spaces with at least one further space of the plurality of spaces, oil received from the suction sump into the lowermost one of the spaces and thereby into the distribution channel being urged along the distribution channel and delivered to locations between the superposed surfaces during movement of the orbital scroll member.

2. The horizontal scroll compressor assembly of claim 1, wherein the lowermost one of the spaces has at least one cylindrical surface, and the anti-rotation mechanism comprises a cylindrical member disposed in the lowermost one of the spaces, the cylindrical surface of the space moved about the cylindrical member, movement of oil in the lowermost one of the spaces induced by the anti-rotation mechanism, oil from the suction sump receivable into the lowermost one of the spaces forced from the lowermost one of the spaces into the oil distribution channel during movement of the orbital scroll member.

3. The horizontal scroll compressor assembly of claim 2, wherein the lowermost one of the spaces is toroidal and has a pair of concentric cylindrical surfaces between which the cylindrical member is located.

4. The horizontal scroll compressor assembly of claim 3, wherein the oil distribution channel includes at least two groove segments fluidly interconnected through the toroidal space, oil forced into at least one of the groove segments pumped along the oil distribution channel during the movement of the orbital scroll member.

5. The horizontal scroll compressor assembly of claim 4, wherein the oil distribution channel includes two or more groove segments arranged about the axis, an end of one the groove segment fluidly interconnected to an end of another the groove segment through the toroidal space.

6. The horizontal scroll compressor assembly of claim 1, wherein the oil distribution channel has a shallower depth than the plurality of spaces and includes an elongate groove segment.

7. The horizontal scroll compressor assembly of claim 6, wherein the oil distribution channel includes a plurality of the elongate groove segments, an end of one the groove segment fluidly interconnected with an end of another the groove segment within the orbital scroll member.

8. The horizontal scroll compressor assembly of claim 7, wherein the space is at least partially located in the suction sump and is receivable of oil from the suction sump.

9. The horizontal scroll compressor assembly of claim 8, wherein the anti-rotation mechanism comprises a pair of concentric cylindrical surfaces between which at least a portion of the space is located, and a cylindrical member having a fixed location about the axis relative to the housing, the cylindrical member diametrically extending between the concentric cylindrical surfaces, movement of oil in the space induced by relative movement between the concentric cylindrical surfaces and the cylindrical member, oil received from the suction sump into the space forced from the space into the oil distribution channel during the movement of the orbital scroll member.

10. The horizontal scroll compressor assembly of claim 9, wherein the cylindrical member is a needle roller bearing assembly on which at least one of the concentric cylindrical surfaces rides during the movement of the orbital scroll member.

* * * * *